US008373121B2

(12) United States Patent
De Chambost

(10) Patent No.: US 8,373,121 B2
(45) Date of Patent: Feb. 12, 2013

(54) MAGNETIC ACHROMATIC MASS SPECTROMETER WITH DOUBLE FOCUSING

(75) Inventor: Emmanuel De Chambost, Limours (FR)

(73) Assignee: Cameca, Gennevilliers (FR)

( * ) Notice: Subject to any disclaimer, the term of this patent is extended or adjusted under 35 U.S.C. 154(b) by 0 days.

(21) Appl. No.: 13/148,141

(22) PCT Filed: Jan. 29, 2010

(86) PCT No.: PCT/EP2010/051101

§ 371 (c)(1), (2), (4) Date: Oct. 27, 2011

(87) PCT Pub. No.: WO2010/089260

PCT Pub. Date: Aug. 12, 2010

(65) Prior Publication Data

US 2012/0032075 A1 Feb. 9, 2012

(30) Foreign Application Priority Data

Feb. 6, 2009 (FR) ..... 09 50764

(51) Int. Cl.
*H01J 49/32* (2006.01)
*H01J 49/26* (2006.01)

(52) U.S. Cl. ..... 250/298; 250/294; 250/296; 250/396 R; 250/281

(58) Field of Classification Search ..... 250/296, 250/298, 294, 396 R, 281
See application file for complete search history.

(56) References Cited

U.S. PATENT DOCUMENTS

| | | | | |
|---|---|---|---|---|
| 4,507,555 | A * | 3/1985 | Chang | 250/281 |
| 4,638,160 | A * | 1/1987 | Slodzian et al. | 250/296 |
| 5,189,304 | A * | 2/1993 | De Chambost et al. | 250/296 |
| 6,979,818 | B2 * | 12/2005 | Scheidemann et al. | 250/299 |

FOREIGN PATENT DOCUMENTS

| | | | |
|---|---|---|---|
| EP | 0124440 | A1 | 11/1984 |
| EP | 0473488 | A2 | 3/1992 |
| FR | 1576381 | A | 8/1969 |

OTHER PUBLICATIONS

Yavor M.I. et al.: "Beam distortions and their compensation in sector field mass spectrometers," International Journal of Mass Spectrometry and Ion Processes, Elsevier Scientific Publishing Co. Amsterdam, NL, vol. 171, No. 1-3, Dec. 1, 1997, pp. 203-208.

Brenton A.G. et al.: "Calculation of the effect of collisional broadening on high-resolution translational energy loss spectra," International Journal of Mass Spectrometry, Elsevier Science Publishers, Amsterdam, NL, vol. 230, No. 2-3, Dec. 1, 2003, pp. 185-192.

Matsuda H: "Electrostatic analyzer with variable focal length," Review of Scientific Instruments USA, vol. 32, No. 7, Jul. 1961, pp. 850-852.

De Chambost et al.: "Achieving high transmission with the Cameca IMS 1270," Proceedings 10th Int Conf Secondary Ion Mass Spectrometry, Sims X, Wiley, Chichester, UK, 1991, pp. 1003-1006.

* cited by examiner

*Primary Examiner* — Nikita Wells
(74) *Attorney, Agent, or Firm* — Baker Hostetler LLP

(57) ABSTRACT

An achromatic magnetic mass spectrometer, for example of the SIMS type with double focusing, comprises means for canceling the four aberrations of the second order, and means for canceling the off-axis achromatism and for modulating the dispersion in mass.

5 Claims, 3 Drawing Sheets

MAGNETIC ACHROMATIC MASS SPECTROMETER WITH DOUBLE FOCUSING

CROSS-REFERENCE TO RELATED APPLICATIONS

This application is a National Stage of International patent application PCT/EP2010/051101, filed on Jan. 29, 2010, which claims priority to foreign French patent application No. FR 09 50764, filed on Feb. 6, 2009, the disclosures of which are incorporated by reference in their entirety.

FIELD OF THE INVENTION

The present invention relates to an achromatic magnetic mass spectrometer with double focusing.

BACKGROUND OF THE INVENTION

Mass spectrometers are devices allowing the chemical structure of the constituent molecules of a sample or analyte to be characterized. Mass spectrometry is thus a micro-analysis technique that typically only requires a few picomoles of the sample in order to extract from it characteristic information regarding its molecular weight or its molecular structure. There exist various types of mass spectrometers, amongst which may be noted mainly time-of-flight mass spectrometers, quadrupole mass spectrometers and magnetic mass spectrometers. Reference may for example be made to a general publication such as that by John Roboz, Introduction to mass spectrometry, Instrumentation and techniques, published by Interscience publishers, 1968, or else by J. Throck Watson, Introduction to Mass Spectrometry, published by Lippincott-Raven, 1997, notably introducing the various types of mass spectrometers and their principles of operation. Magnetic mass spectrometers may be further separated into spectrometers with single focusing and spectrometers with double focusing. As far as the theoretical aspects relating to the optical properties of mass spectrometers are concerned, reference may be made to the work by H. Wollnik, Optics of charged particles, published by Academic Press, 1987.

In the following, the qualification "optical" is to be considered as it is accepted in its wider sense, here applied to ion optics.

One particular type of mass spectrometry is commonly denoted by the name SIMS, which is an acronym for the expression "Secondary Ion Mass Spectrometry". One of the problems specific to this technique of analysis is that the ions accelerated in the mass spectrometer exhibit a large energy dispersion. Regarding the chromatic properties of mass spectrometers, and notably the devices involving ions exhibiting a large energy dispersion, reference may usefully be made to the work by A. Benninghoven et al., Secondary Ion Mass Spectrometry, published by John Wiley, 1987. This publication notably deals with SIMS techniques.

The present invention falls notably into the field of mass spectrometers of the SIMS type. In spectrometers of this type, it is known that the principle for extraction of the secondary ions leads to a large dispersion in energy of the emitted ions. It is furthermore known that an electrostatic section may advantageously be introduced into mass spectrometers of the SIMS type between the sample and the magnetic section, this electrostatic section being designed to render the mass spectrometer achromatic for at least one mass. It is commonly possible to vary the magnetic field produced by the magnetic section. This is easily achieved by varying the electrical excitation, for example in the case where the magnetic field is produced by an electromagnet. In this case, the condition for achromatism is not associated with a given mass, but with a particular trajectory. If this trajectory is considered as the main axis of the spectrometer, the spectrometer is said to be achromatic on the axis, and not to be achromatic away from the axis or "off-axis".

Still more particularly, the present invention may relate both to a spectrometer referred to as "single-collection", in other words capable of measuring a mass along the axis, and to a mass spectrometer referred to as "multi-collection", in other words capable of measuring several masses simultaneously. It is for example possible to simultaneously measure several masses by disposing a plurality of collectors in the focal plane of the mass spectrometer. The blur observed at the focal point of a given mass different from the on-axis mass, when the energy distribution of the ions is relatively broad, is called off-axis chromatic aberration. Employing the notation of H. Wollnik, presented in the aforementioned publication, this blur may be characterized by an aberration coefficient x/em defined by the equation:

$$\Delta x1=(x/em)\times(\Delta E/E)\times(M1-M0)/M0,$$

where M0 is the mass on the main axis for which there is good chromatic focusing, ΔE the energy dispersion of the beam, and Δx 1 the blur formed at the place where the trajectories of the mass M1 are focused at the opening.

It is desired to reduce the blur Δx 1 in order to improve the off-axis mass resolution. In order to reduce this blur, the aim is to cancel the coefficient x/em. In multi-collection mass spectrometers, it is therefore necessary, in order to guarantee a good resolution in mass for various masses, to be able to eliminate or significantly reduce the off-axis chromatic aberrations.

Various types of mass spectrometers exist known from the prior art, which are constructed so as to be achromatic on the axis. Amongst these types of spectrometers, the Nier-Johnson spectrometer may be mentioned.

The Mattauch-Herzog spectrometer, also known from the prior art, is notably characterized by the fact that the exit face of the magnet is aligned with the entry point. This particular configuration enables a certain number of noteworthy properties, and notably allows achromatism to be obtained for various masses. However, it is sometimes very advantageous for a mass spectrometer to have a large dispersion in mass, and in this case, the Mattauch-Herzog spectrometer is not suitable.

It is furthermore known that it is preferable, with the aim of increasing the resolution in mass, to eliminate or reduce the aberrations of the second order. It is recalled here that the use in mass spectrometers of elements that are not axisymmetric about the main axis, such as the electrostatic and magnetic sections, leads to aberrations of the second order. These aberrations cannot, by definition, be corrected by a focusing process. Four types of aberrations of the second order are produced in mass spectrometers comprising a magnetic section and an electrostatic section; these aberrations of the second order are denoted according to the usage in the field of optics or of ion optics: a first aberration denoted x/aa proportional to the square of the opening angle in the radial plane, a second aberration x/bb proportional to the square of the opening angle in the transverse plane, a third aberration x/ae proportional to the opening angle in the radial plane and to the relative difference in energy, and a fourth aberration x/ee proportional to the square of the relative difference in energy.

It is known that the respective geometrical parameters of the electrostatic section and of the magnetic section and of other ion optics devices may be calculated in such a manner that the 4 second order aberration coefficients cancel each other out. For example, reference may be made to the work by H. Matsuda, Double focusing mass spectrometer of second order, International Journal of Mass Spectrometry and Ion Processes, 14 (1974). In this publication, a spectrometer with double focusing designed with a set of very precisely determined physical and geometrical parameters is notably proposed. This type of solution has several drawbacks: there is no possibility of adjusting the correction for the aberrations and, if the calculations are not completely exact, the aberrations are not really canceled.

Furthermore, this type of spectrometer cannot be differently adjusted according to the type of performance specifications that it is desired to favor: for example, a very good resolution in mass only on the axis or else a reasonably good resolution in mass for all the masses detected by the multi-collection. Lastly, this type of spectrometer is not stigmatic, in other words it is impossible to dispose at the exit of the spectrometer an ion microscope function which enables an image of the sample, filtered in mass, to be displayed.

It is also known that hexapoles can correct aberrations of the second order. Reference may, for example, be made to the aforementioned work by Wollnik. A hexapole is a set of six poles disposed about the main axis, and alternately biased at an electrical potential of +V or −V.

Spectrometers known from the prior art are equipped with correcting electrostatic hexapoles: a mass spectrometer with single focusing as described in the European patent application EP 0124440 or a mass spectrometer with double focusing such as described in the U.S. Pat. No. 4,638,160. The advantage of introducing electrostatic hexapoles in order to reduce the aberrations is that it is then possible to adjust the aberration correction as finely as possible by adjusting the excitation voltage of the hexapole while at the same time observing a signal characteristic of the sharpness of the spot, such as for example the signal resulting from the scanning of the beam over the edge of the exit slit of the spectrometer, which exit slit is disposed upstream of a counting mechanism or the projection onto an ion-photon conversion device, such as a microchannel wafer, of the image of the ion beam in the plane of the exit slit.

In a mass spectrometer with stigmatic double focusing, it is known that as long as a difference in magnification between the image in the radial plane and the transverse plane is not created, it is not possible to simultaneously cancel the aforementioned first and second aberrations of the second order x/aa and x/bb; but it is also known that if this difference in magnification is created with the appropriate means such as described in the European patent application EP0473488, it is then possible to simultaneously cancel these two aberrations.

Reference may be made to the article by E. de Chambost et al., Achieving High Transmission with the Cameca IMS1270, Secondary Mass Spectrometry, SIMSX, published by John Wiley, 1995, where it is notably stated that with a hexapole situated between the entry slit and the electrostatic section, a hexapole situated upstream of the magnetic section and a hexapole situated downstream of the magnetic section, the aforementioned first three aberrations of the second order x/aa, x/bb and x/ae may be canceled. This configuration allows the transmission for a resolution in mass of the order of 10,000 to be considerably improved. However, the fourth aberration of the second order x/ee is not canceled, which represents a serious drawback when resolutions in mass greater than 20,000 are required.

SUMMARY OF THE INVENTION

One aim of the present invention is to overcome at least the above-mentioned drawbacks, by providing a solution for significantly reducing the four aberrations of the second order, together with the off-axis chromatic aberrations, while at the same time allowing modulation of the dispersion in mass, for example a reduction of the dispersion in mass in order to concentrate the masses onto the focal plane so as to reduce the travel of mobile collectors or else an increase of the dispersion in mass in order to be able to measure closer-spaced masses with a multi-collection system.

For this purpose, the subject of the invention is a magnetic mass spectrometer with double focusing comprising an ion source, an entry slit, an electrostatic section, a magnetic section and means for simultaneous detection of at least one ion mass, characterized in that it comprises:

- a first electrostatic device placed between the ion source and the exit of the electrostatic section, focusing the beam of ions onto the main axis of the mass spectrometer;
- a second electrostatic device disposed downstream of the magnetic section, creating in the longitudinal plane of symmetry a radial electric field that is higher the further the point in question is from the axis and whose respective signs, on the side of the low masses and on the side of the high masses, are opposing;
- the electrostatic section is a truncated spherical electrostatic section comprising an external electrode to which a +Ve voltage is applied, and an internal electrode to which a −Ve voltage is applied, the external electrode and the internal electrode furthermore comprising a pair of external parallel plates disposed on either side of the external electrode and to which a voltage $V_{ext}$ is applied, and a pair of internal parallel plates disposed on either side of the internal electrode and to which a voltage $V_{int}$ is applied, said pairs of internal and external parallel plates forming the first electrostatic device;

the voltages $V_{ext}$, $V_{int}$ respectively applied to the external and internal parallel plates being adjusted by the same voltage difference ΔV each time that the second electrostatic device is activated, in order to modulate the dispersion in mass or in order to cancel the off-axis chromatism, in such a manner that the beam of ions corresponding to the on-axis mass always remains focused on the main axis.

In one embodiment of the invention, the magnetic mass spectrometer can be characterized in that the second electrostatic device comprises an electrostatic lens and/or a quadrupole and/or an octopole centered on the main axis of the mass spectrometer and whose North and South poles, situated in the transverse plane and on an axis perpendicular to the radial axis, are biased at an electrical potential V, and whose East and West poles situated on an axis situated in the radial plane, perpendicular to the axis defined by the North and South poles, are biased at an electrical potential −V.

In one embodiment of the invention, the magnetic mass spectrometer can be characterized in that the first electrostatic device comprises a lens and/or a quadrupole and/or a multipole activated as a stigmator.

In one embodiment of the invention, the mass spectrometer can be characterized in that it furthermore comprises means for canceling the aberrations of the second order, said means comprising:

- a first hexapole canceling the aberrations of the second order in x/bb,
- a second hexapole canceling the aberrations of the second order in x/ee,
- a third hexapole canceling the aberrations of the second order in x/ae,
- a fourth hexapole canceling the aberrations of the second order in x/aa.

BRIEF DESCRIPTION OF THE DRAWINGS

Other features and advantages of the invention will become apparent upon reading the description, presented by way of example and with regard to the appended drawings, which show.

DETAILED DESCRIPTION

Figure 1:
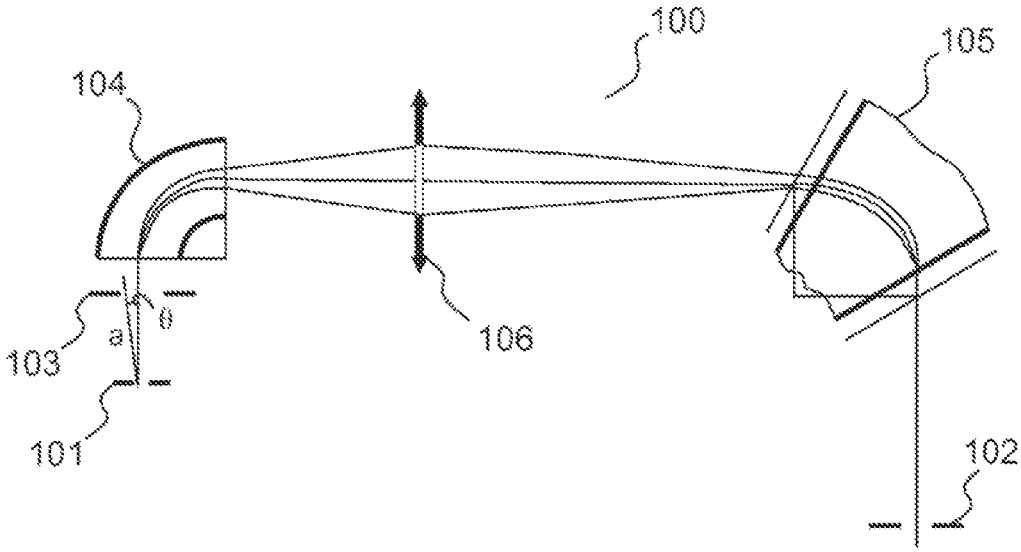
FIG. 1, a schematic diagram of one example of an on-axis achromatic magnetic mass spectrometer known from the prior art, FIG. 2, an overall assembly diagram of one example of a magnetic mass spectrometer according to the present invention, FIGS. 3*a*, 3*b*, 3*c* and 3*d*, diagrams showing one preferred exemplary embodiment for devices equipping a magnetic mass spectrometer according to the present invention.

FIG. 1 shows, by way of a schematic diagram, one example of an on-axis achromatic magnetic mass spectrometer known from the prior art.

A magnetic mass spectrometer 100 is shown through a cross-section in the radial plane. The mass spectrometer 100 comprises an entry slit 101 and an exit slit 102. A diaphragm 103 is situated downstream of the entry slit 101. An electrostatic section 104 is situated downstream of the diaphragm 103. A magnetic section 105 is disposed downstream of the electrostatic section 104. An optical device 106 is situated between the electrostatic section 104 and the magnetic section 105.

It is first of all recalled that the radial plane is defined as the plane of symmetry of the mass spectrometer containing the main axis of the mass spectrometer 100, perpendicular to the large dimension of the entry slit 101 and containing the main axis of the mass spectrometer 100. At a given point, the transverse plane is defined as the plane which is perpendicular to the radial plane and which also contains the main axis of the mass spectrometer 100.

For the sake of clarity, it is considered that the mass spectrometer per se is situated downstream of the entry slit 101, and the ionization device and the ion-beam-forming devices up to the entry slit 101 are not shown in the figure. Similarly, the collection and measurement devices situated downstream of the exit slit 102 are not shown.

In the radial plane, the opening angle θ of the ion beam is denoted by a. The opening angle of the ion beam in the transverse plane, not shown in the figure, is denoted by b.

The mass spectrometer shown in the figure is a Nier-Johnson spectrometer. This type of spectrometer is one example of an on-axis achromatic mass spectrometer. A particular configuration of the physical and geometrical characteristics of the mass spectrometer 100 allows the measurement in the axis of a given mass with a given resolution in mass.

Figure 2:
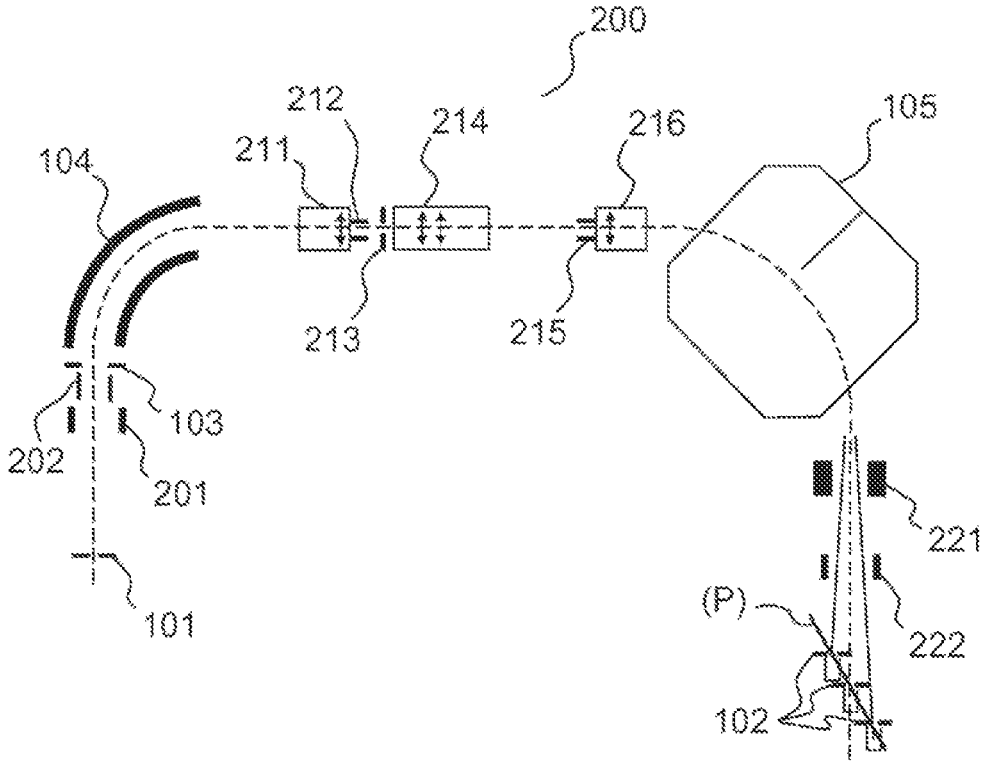

FIG. 2 shows an overall assembly diagram of one example of a magnetic mass spectrometer according to the present invention.

The magnetic mass spectrometer 200 comprises an entry slit 101, a plurality of exit slits 102 designed to filter the beams of ions toward a plurality of collectors, which are not shown in the figure for reasons of clarity. The mass spectrometer 200 also comprises a first diaphragm 103, an electrostatic section 104 and a magnetic section 105. The mass spectrometer 200 furthermore comprises, upstream of the electrostatic section 104, a first electrostatic device 201 situated downstream of the entry slit 101, and a first hexapole 202 downstream of the first electrostatic device 201 and upstream of the diaphragm 103.

Downstream of the electrostatic section 104 and upstream of the magnetic section 105, the mass spectrometer 200 comprises, in series, a first optical device 211, a second hexapole 212, a second diaphragm 213, a second optical device 214, a third hexapole 215 and a third optical device 216.

Downstream of the magnetic section 105 and upstream of the exit slits 102, the mass spectrometer 200 comprises, in series, a fourth hexapole 221 and a second electrostatic device 222.

Of course, it is recalled that the configuration presented here is given by way of example, and those skilled in the art may envision a multitude of equivalent configurations, and the optical and electrostatic devices should be considered in the wider sense as electrostatic ion-optics systems, which can notably comprise axisymmetric lenses, anisotropic lenses of variable efficiencies in the radial plane and in the transverse plane, respectively, or else multipoles allowing the on-axis achromatism to be obtained, such as the devices commonly used in mass spectrometers with double focusing or even multipoles also allowing the trajectories in the transverse plane to be handled differently, as is for example described in the aforementioned publication by E. de Chambost et al.

There exists a combination between the first electrostatic device 201 and the second electrostatic device 222, respectively situated between the entry slit 101 and the exit of the electrostatic section 104, and between the magnetic section 105 and the exit slits 102, allowing both the problem of the modulation of the dispersion in mass and the problem of the elimination of the off-axis chromatic aberration to be solved. In both cases, it is the second electrostatic device 222 that is active, but as it creates a defocusing of the image of the entry slit 101 in the detection plane, this effect must be compensated with the first electrostatic device 201. The first electrostatic device 201 must not be located either in the region where the trajectories are dispersed in mass, or in those where they are dispersed in energy.

In order to cancel the off-axis chromatic aberrations x/em, the idea of the present invention is to dispose a focusing device—the second electrostatic device 222—in the part where the trajectories are dispersed in mass, in other words between the magnetic section 105 and the exit slits 102. The second electrostatic device 222 is necessarily more efficient around the periphery than in the center, and its convergence is necessarily inversely proportional to the energy of the particle. In other words, such a device produces a displacement of trajectories $$\Delta x = K^*(\Delta E/E)^*(M1-M0)/M0$$

This just needs to be adjusted appropriately so that it is opposed to the off-axis chromatic aberration. This adjustment may, for example, be carried out by means of a suitable calculation program or else by means of appropriate measurements allowing the sharpness of the beam or the displacement of the beam resulting from a shift in energy to be characterized. Amongst the programs adapted to this calculation may be mentioned ISIOS described by M. I. Yavor, A. S. Berdnikov in "ISIOS: a program to calculate imperfect charged particle optical systems" (Nucl. Instr. and Meth. in Phys. Res., Vol 363, n°1, 1995, pp. 416-422) or GIOS described in "Principles of GIOS and COSY, H. Wollnik et al." (AIP Conference Proceedings, ed. C. Eminhizer, Vol. 177 (1988), p.74-75).

This same electrostatic device 222 may be used, with a different excitation, in other words biased with different voltages, when the problem is not to reduce the off-axis aberrations, but to modulate the dispersion in mass.

In both cases, in other words that of the canceling of the off-axis chromatic aberrations and that of the modulating of the dispersion in mass, the unwanted secondary effect is the displacement of the plane of the image of the entry slit. This unwanted secondary effect is compensated by the first electrostatic device 201 which has the same effect on the trajectories, whatever the mass of the ion in question.

The second electrostatic device 222, downstream of the magnetic section 105, produces, in a plane normal to the axis, an electric field that increases the further the point in question is from the axis. This electric field is of opposing sign depending on the location—on the side of the low masses, or on the side of the high masses. These electrostatic means can be an electrostatic lens centered on the axis, in other words a series of axisymmetric electrodes biased by applied voltages. These electrostatic means may also be a quadrupole device such that the plane containing one of the pairs of opposing poles contains the radial plane of the spectrometer. These electrostatic means may also be an octopole where the poles situated on the Ox and Oy axes are excited as quadrupoles, and the poles on the diagonals are set to zero.

The electrostatic means situated between the entry slit 101 and the exit of the electrostatic section 104 are designed to reform the focusing at the opening which is broken by the activation of the devices situated between the magnet and the detector.

In order to cancel all the chromatic aberrations, the invention provides both a set of 4 judiciously positioned hexapoles and a system allowing the relative magnifications of the beam in the radial and transverse planes to be modified between the 2 end hexapoles, i.e. between the first hexapole 202 and the fourth hexapole 221.

The first hexapole 202, disposed in the example in the figure between the entry slit 101 and the electrostatic section 104, is especially dedicated to the canceling of the second aberration of the second order x/bb.

The fourth hexapole 221, disposed between the magnetic section 105 and the detection plane on which the exit slits 102 are situated, is especially dedicated to the canceling of the first aberration of the second order x/aa.

The second hexapole 212, disposed close to the second diaphragm 213 forming a slit in energy, is especially dedicated to the canceling of the fourth aberration of the second order x/ee.

The third hexapole 215, disposed between the second diaphragm 213 and the magnetic section 105, is especially dedicated to the canceling of the third aberration of the second order x/ae.

The system allowing the magnifications in the radial plane and in the transverse plane to be varied, comprising notably the optical devices 211, 214 and 216, may for example be that described in the aforementioned European patent application EP0473488.

Figure 3A:
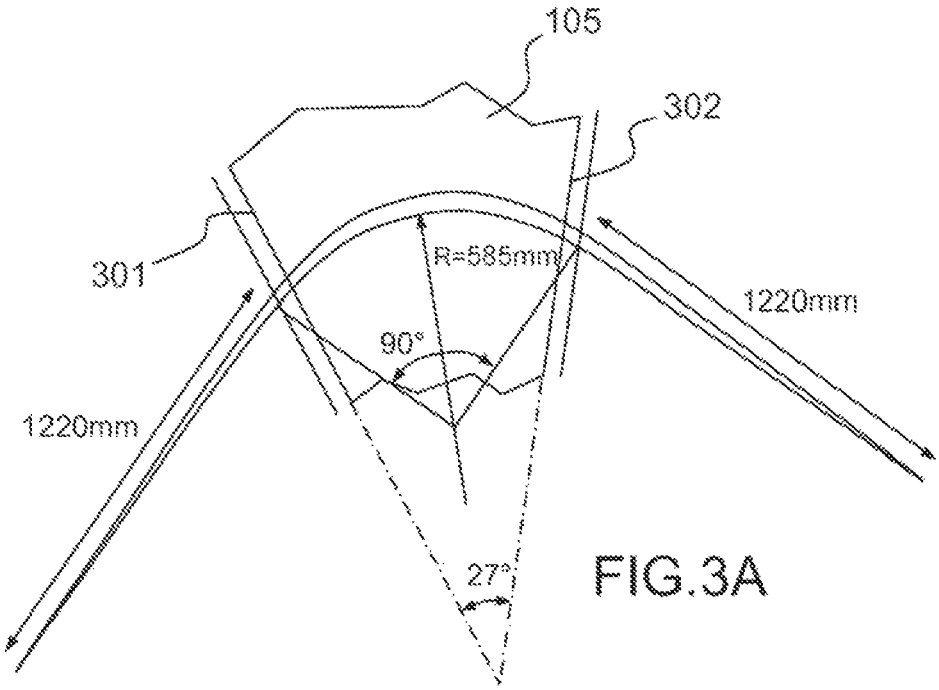

FIG. 3*a* shows one preferred embodiment for the magnetic section 105 of the magnetic mass spectrometer 200 according to the invention.

The structure of the mass spectrometer is for example of the Nier-Johnson type. The magnetic section 105 produces a deflection of the trajectory of the ions at an angle of 90° on the main axis. In the magnetic section 105, the trajectory of the ions on the main axis exhibits a radius of curvature equal to 585 mm. The entry and exit faces 301 and 302 of the magnetic section 105 subtend an angle of 27° with respect to the plane normal to the axis in order to endow the magnetic section 105 with stigmatic properties, according to a configuration known per se from the prior art. The focal point of the mass on the main axis is situated at a distance of 1220 mm from the exit of the magnetic section 105.

Figure 3B:
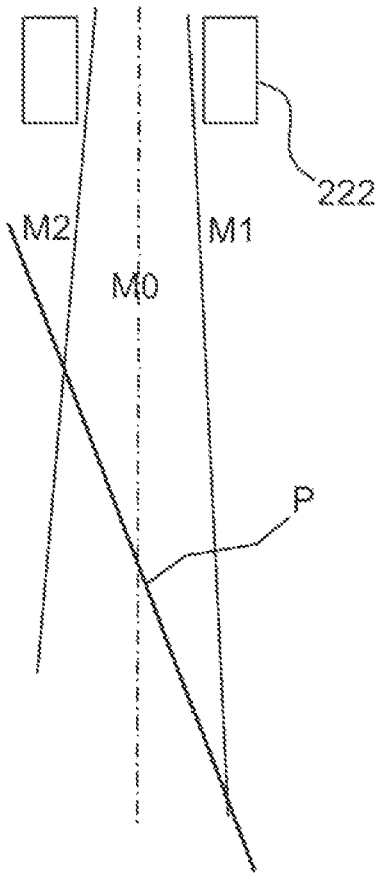

FIG. 3*b* shows one preferred embodiment for the second electrostatic device 222. Three different trajectories for three different masses M0, M1 and M2 are shown. M0 is the mass on the main axis. A tangent plane P is also shown; this plane P is an approximation to the surface onto which the various masses M0, M1 and M2 are focused.

Figure 3C:
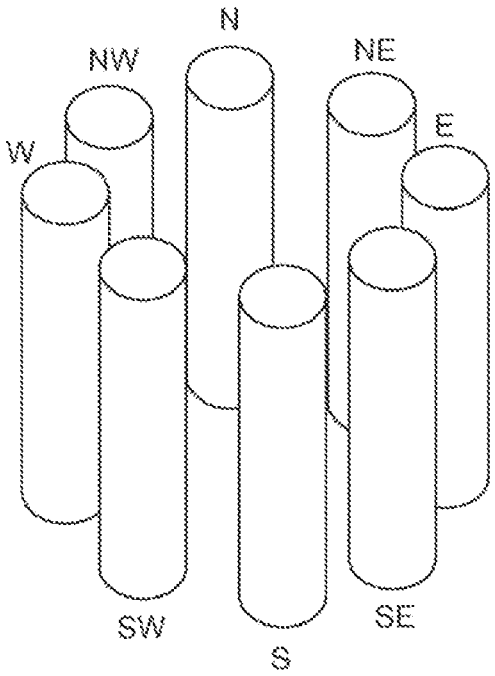

FIG. 3*c* shows a perspective view of a preferred embodiment of an example of an octopole forming the second electrostatic device 222. The octopole 222 comprises eight poles North, North-East, East, South-East, South, South-West, West and North-West formed by eight cylindrical bars disposed around the main axis. The North-South axis is perpendicular to the radial plane and situated in the transverse plane. The East-West axis is perpendicular to the North-South axis and situated in the radial plane.

For example, the octopole 222 of 100 mm depth can be disposed 460 mm upstream of the focal point of the mass M0. The eight poles of the octopole can be situated on a circle with a radius equal to 75 mm. The diameters of the cylindrical poles can be around 30 mm. If it is desired to compress the trajectories of positive ions and to reduce the dispersion in mass, then the North-West, North-East, South-East and South-West poles of the octopole can be excited at 0 Volt, the East and West poles at a positive potential +V, and the North and South poles at the potential −V.

For the particular geometry described hereinabove, mentioned by way of example, the typical value of the voltage V which cancels the off-axis chromatic aberrations is 300 Volts, for an ion kinetic energy of 10 keV. At the same time as the compensation for chromatic aberration, the application of a voltage to the poles has the effect of tightening the trajectories dispersed in mass, thus reducing the dispersion in mass, typically by a factor of ⅔.

If an electrostatic lens is used rather than an octopole, in other words for example a lens known as an Einzel lens, with an active electrode of the same inside diameter as the octopole, the same effect can be obtained. Typically, a voltage of the order of half the acceleration voltage of the ions must be applied to the active electrode, which voltage, in addition to the cancellation of the off-axis chromatic aberration, also has the effect of reducing the dispersion in mass by a factor of around ⅔.

In the two cases presented hereinabove, the additional convergence introduced by the second electrostatic device 222 disturbs the focusing at the opening of the entry slit 101 in the plane of the exit slit 102. In order to compensate for this phenomenon, a focusing device situated in a region where the beam is neither dispersed in mass nor dispersed in energy needs to be activated.

Figure 3D:
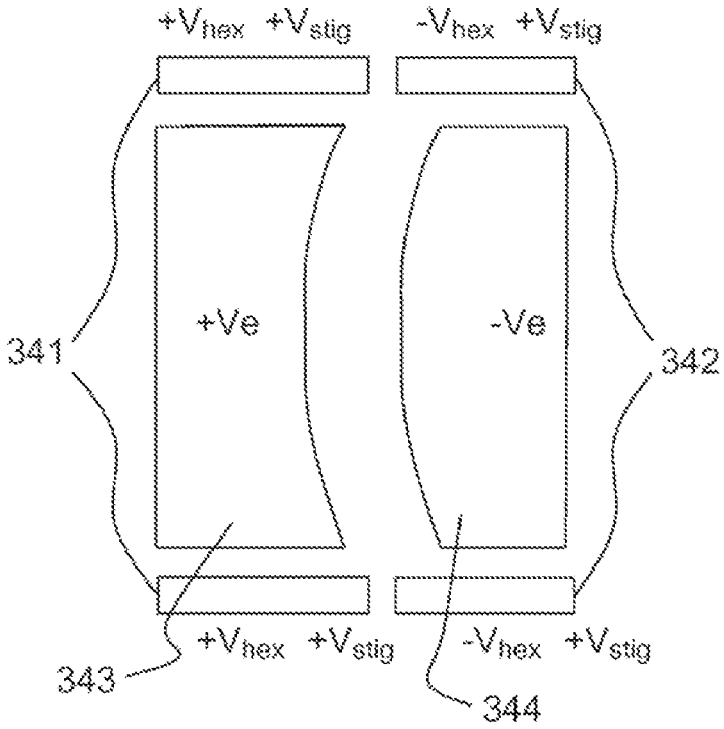

In one preferred embodiment of the invention, a stigmator function can be integrated into the electrostatic section 104, as illustrated by FIG. 3*d*.

FIG. 3*d* shows an exemplary embodiment of an electrostatic section 104, viewed in cross-section in a plane perpendicular to the main axis of the mass spectrometer. The electrostatic section 104 comprises for example a pair of additional external parallel plates 341 and a second pair of internal parallel plates 342, called Matsuda plates disposed on a truncated spherical electrostatic section composed of an external electrode 343 where, in the case of positively charged ions, a voltage +Ve is applied, and of an internal electrode 344 where, still in the case of positively charged ions, a voltage −Ve is applied. The 2 external plates 341, symmetric with respect to the radial plane, are connected together, and the 2 internal plates 342 are also connected together. The additional plates 341 and 342 restore to the truncated section a full spherical symmetry, if respective voltages $V_{ext}$ and $V_{int}$ determined by calculation or by experiment are applied to them. The voltages $V_{ext}$ and $V_{int}$ may be expressed in the form of a differential component $V_{hex}$ and a common component $V_{stig}$:

$$V_{ext}=V_{hex}+V_{stig}$$

$$V_{int}=-V_{hex}+V_{stig}$$

The conventional means of analog or digital electronics allow the voltages $V_{ext}$ and $V_{int}$ to be generated starting from the voltages $V_{hex}$ and $V_{stig}$ which may of course be controlled by computer.

In other words, the application to the plates 341 and 342 of a common component $V_{stig}$ creates a stigmator effect which can be judiciously employed to compensate for the defocusing created by the second electrostatic device 222 disposed downstream of the magnetic section 105, but without having any effect on the dispersion in mass. In this embodiment, it is therefore possible to substitute the Matsuda plates 341 and 342 for the first electrostatic device 201.

When the aim is to cancel the off-axis chromatic aberration, it is possible to calculate, for example with the aforementioned calculation programs, what are the electrical voltages that need to be applied to the various electrostatic devices, but it is also possible to determine the latter by purely experimental methods. The method proposed may then be as follows. It is first of all noted that the width EE and the position of the slit in energy, both expressed in eV, are easily converted into units of length by using the energy dispersion coefficient $K_e$ of an electrostatic section, according to a calculation known per se to those skilled in the art: dx (mm)=$K_e$ ($\Delta E/E$), where E is the acceleration energy of the ions:

- a value is assigned to the excitation of the second electrostatic device 222,
- the value of the excitation of the first electrostatic device 201 is adjusted in order to refocus the beam onto the axis. In the embodiment previously described, where the first electrostatic device 201 is formed by the additional plates 341 and 342, it is for example possible to adjust the voltages $V_{ext}$ and $V_{int}$ which are respectively applied to them, by the same voltage difference $\Delta V$;
- the second diaphragm 213 or slit in energy, disposed between the electrostatic section 104 and the magnetic section 105, is adjusted to a low value, typically 1 eV;
- this slit is scanned, typically over a range from zero to 20 eV, in other words the slit in energy is displaced by regular increments over this range;
- the displacement induced by the beam on an off-axis collector is observed. Typically, by scanning the exit beam over the entry slit of this collector, in other words at the exit slit 102 associated with this collector. The displacement induced is characteristic of the off-axis chromatic aberration, this being the aberration that it is desired to cancel in this step;
- it is then possible, by successive iterations, to determine the value of the excitation for the second device 222 which provides a minimum off-axis chromatic aberration.

One advantage of the invention is that this method only has to be run once and only once during the lifetime of the mass spectrometer 200.

With regard to the canceling of the four aberrations of the second order, each of the four hexapoles is excited by a single parameter: the voltage which is applied to 3 poles being positive and to the other 3 poles being negative. The method allowing these 4 hexapoles to be adjusted may for example be as follows, once again referring to FIG. 2:

- the adjustment of the second hexapole 212 is first of all carried out;
- the first diaphragm 103, commonly called field diaphragm or else angular opening diaphragm, is closed in order to sufficiently reduce the openings a and b in such a manner that the first, second and third aberrations of the second order, being respectively $(x/aa).a^2$, $(x/bb).b^2$ and (x/ae) .a.e, are negligible;
- it is then possible to vary the energy of the ions, for example by varying the acceleration voltage of the ions. Or else, when the process of emission of the ions produces a large distribution in energy, it will suffice to close the second diaphragm 213 or slit in energy, and to move this slit in energy thus closed. When the fourth aberration of the second order x/ee is not canceled, this variation in the energy of the ions results in a displacement of the image of the entry slit 101 that it is possible to measure: it is therefore possible to adjust the excitation of the second hexapole 212 such that this displacement is at a minimum;
- the adjustment of the first hexapole 202 is then carried out, for example by minimizing the width of the beam that may be observed directly on an image of the exit plane produced on a micro-channel wafer associated with a phosphorescent screen or indirectly by observing the width of the front S(M) obtained by scanning the exit beam over the edge of the exit slit and measuring the ion current S downstream of the exit slit. The exit beam is scanned by incrementing in regular steps the magnetic field with which is associated a value of the mass M of the ion associated with the on-axis trajectory.
- the adjustment of the third hexapole 215 is then carried out;
- finally, the adjustment of the fourth hexapole 221 is carried out.

The invention claimed is:

1. A magnetic mass spectrometer with double focusing comprising an ion source, an entry slit, an electrostatic section, a magnetic section and means for simultaneous detection of at least one ion mass, comprising:

- a first electrostatic device placed between the ion source and the exit of the electrostatic section, focusing the beam of ions onto the main axis of the mass spectrometer;
- a second electrostatic device disposed downstream of the magnetic section, creating in the longitudinal plane of symmetry a radial electric field that is higher the further the point in question is from the axis and whose respective signs, on the side of the low masses and on the side of the high masses, are opposing; wherein
- the electrostatic section is a truncated spherical electrostatic section comprising an external electrode to which a +Ve voltage is applied, and an internal electrode to which a −Ve voltage is applied, the external electrode and the internal electrode furthermore comprising a pair of external parallel plates disposed on either side of the external electrode and to which a voltage $V_{ext}$ is applied, and a pair of internal parallel plates disposed on either side of the internal electrode and to which a voltage $V_{int}$ is applied, said pairs of internal and external parallel plates forming the first electrostatic device;
- the voltages $V_{ext}$, $V_{int}$ respectively applied to the external and internal parallel plates being adjusted by the same voltage difference $\Delta V$ each time that the second electrostatic device is activated, in order to modulate the dispersion in mass or in order to cancel the off-axis chromatism, in such a manner that the beam of ions corresponding to the on-axis mass always remains focused on the main axis.

2. The magnetic mass spectrometer according to claim 1, wherein the second electrostatic device comprises an electrostatic lens centered on the main axis of the mass spectrometer and whose North and South poles, situated in the transverse plane and on an axis perpendicular to the radial axis, are biased at an electrical potential V, and whose East and West poles situated on an axis situated in the radial plane, perpendicular to the axis defined by the North and South poles, are biased at an electrical potential −V.

3. The magnetic mass spectrometer according to claim 1, further comprising:

means for canceling the aberrations of the second order, said means comprising a first hexapole canceling the aberrations of the second order proportional to the square of the opening angle in the transverse plane referred to as aberrations in x/bb, a second hexapole canceling the aberrations of the second order proportional to the square of the relative difference in energy referred to as aberrations in x/ee, a third hexapole canceling the aberrations of the second order proportional to the opening angle in the radial plane and to the relative difference in energy referred to as aberrations in x/ae, a fourth hexapole canceling the aberrations of the second order proportional to the square of the opening angle in the radial plane referred to as aberrations in x/aa.

4. The magnetic mass spectrometer according to claim 1, wherein the second electrostatic device comprises a quadrupole centered on the main axis of the mass spectrometer and whose North and South poles, situated in the transverse plane and on an axis perpendicular to the radial axis, are biased at an electrical potential V, and whose East and West poles situated on an axis situated in the radial plane, perpendicular to the axis defined by the North and South poles, are biased at an electrical potential −V.

5. The magnetic mass spectrometer according to claim 1, wherein the second electrostatic device comprises an octopole centered on the main axis of the mass spectrometer and whose North and South poles, situated in the transverse plane and on an axis perpendicular to the radial axis, are biased at an electrical potential V, and whose East and West poles situated on an axis situated in the radial plane, perpendicular to the axis defined by the North and South poles, are biased at an electrical potential −V.

* * * * *